US008931474B2

(12) United States Patent
Benedetti et al.

(10) Patent No.: US 8,931,474 B2
(45) Date of Patent: Jan. 13, 2015

(54) FIREPLACE LINER

(75) Inventors: Joseph A. Benedetti, Nashville, TN (US); Michael L. Bennett, White House, TN (US); Kenneth D. Johns, Chapel Hill, TN (US)

(73) Assignee: Innovative Hearth Products LLC, Nashville, TN (US)

( * ) Notice: Subject to any disclaimer, the term of this patent is extended or adjusted under 35 U.S.C. 154(b) by 238 days.

(21) Appl. No.: 13/405,178

(22) Filed: Feb. 24, 2012

(65) Prior Publication Data

US 2012/0216795 A1 Aug. 30, 2012

Related U.S. Application Data

(60) Provisional application No. 61/446,939, filed on Feb. 25, 2011.

(51) Int. Cl.

| | |
|---|---|
| ***F24B 1/18*** | (2006.01) |
| ***F24C 3/08*** | (2006.01) |
| ***F24C 3/00*** | (2006.01) |
| ***F23D 14/10*** | (2006.01) |
| ***F23D 14/46*** | (2006.01) |
| ***F23D 14/70*** | (2006.01) |

(52) U.S. Cl.

CPC ..... *F24C 3/08* (2013.01); *F24B 1/1808* (2013.01); *F24C 3/006* (2013.01); *F23D 14/10* (2013.01); *F23D 14/46* (2013.01); *F23D 14/70* (2013.01); *F23D 2213/00* (2013.01)

USPC ..... 126/512

(58) Field of Classification Search

CPC ..... F24B 1/1808; F24B 1/18; F24B 1/189; F24B 1/19; F24B 1/191; F24B 1/1902

USPC ..... 126/512

See application file for complete search history.

(56) References Cited

U.S. PATENT DOCUMENTS

| | | | | |
|---|---|---|---|---|
| 3,042,109 | A * | 7/1962 | Peterson | 126/512 |
| 3,314,610 | A * | 4/1967 | Reznor | 431/286 |
| 5,723,183 | A * | 3/1998 | Williams et al. | 427/409 |
| 6,260,548 | B1 * | 7/2001 | Wade | 126/512 |
| 8,166,965 | B2 * | 5/2012 | Miles et al. | 126/523 |

* cited by examiner

*Primary Examiner* — Kenneth Rinehart
*Assistant Examiner* — Gajanan M Prabhu

(57) ABSTRACT

A fireplace liner comprising a first panel configured to be located in front of a fireplace burner assembly that has a lateral dimension that extends across a viewing window of a fireplace box. The first panel is configured to extend laterally along the lateral dimension, and, a rear end of the first panel, nearest to the burner assembly, includes a first trough having a vertical wall with a plurality of first slots therein. The liner comprises a second panel configured to be located behind the burner assembly in the box. The second panel is configured to extend laterally along the lateral dimension, and a front end of the second panel, nearest to the burner assembly, includes a second trough having another vertical wall with a plurality of second slots therein. The first and second slots permit secondary air flow there-through.

20 Claims, 5 Drawing Sheets

FIREPLACE LINER

CROSS-REFERENCE TO RELATED APPLICATION

This application claims the benefit of U.S. Provisional Application Ser. No. 61/446,939, filed by Joseph A. Benedetti et al. on Feb. 25, 2011, entitled "IMPROVED LINEAR FIREPLACE WITH BURNER," commonly assigned with this application and incorporated herein by reference.

TECHNICAL FIELD

This application is directed, in general, to fireplaces and, more specifically, to a liner for a fireplace, and to a method of manufacturing the fireplace liner.

BACKGROUND

Traditional fireplace designs often display the burner assembly in plain view from through the viewing window of the fireplace. In some cases, with varying degrees of effectiveness, loose media (e.g., glass) is piled up around, or on top of, the burner assembly in an effort to hide it from view.

SUMMARY

One embodiment of the present disclosure is a fireplace liner. The liner comprises a first panel configured to be located in front of a fireplace burner assembly that has a lateral dimension that extends across a viewing window of a fireplace box. The first panel is configured to extend laterally along the lateral dimension, and, a rear end of the first panel, nearest to the burner assembly, includes a first trough having a vertical wall with a plurality of first slots therein, the first slots permitting secondary air flow there-through. The liner also comprises a second panel configured to be located behind the fireplace burner assembly in the firebox. The second panel is configured to extend laterally along the lateral dimension, and a front end of the second panel, nearest to the burner assembly, includes a second trough having another vertical wall with a plurality of second slots therein, the second slots permitting secondary air flow there-through.

Another embodiment is a fireplace, comprising a fireplace box having a viewing window, a burner assembly having a lateral dimension that extends across the viewing window and the above discussed fireplace liner.

Another embodiment of the present disclosure is a method of manufacturing a fireplace. The method comprises providing a fireplace box and placing a burner assembly in the fireplace box, such that a lateral dimension of the burner assembly extends across a viewing window of the fireplace box. The method also comprises placing a fireplace liner inside the fireplace box, including mounting a first panel in front of the burner assembly and mounting a second panel behind the burner assembly. The first panel is mounted such that the first panel extends laterally along the lateral dimension, and a rear end of the first panel, nearest to the burner assembly, includes a first trough having a vertical wall with a plurality of first slots therein, the first slots permitting secondary air flow there-through. The second panel is mounted such that the second panel extends laterally along lateral dimension, and a front end of the second panel, nearest to the burner assembly, includes a second trough having another vertical wall with a plurality of second slots therein, the second slots permitting secondary air flow there-through.

BRIEF DESCRIPTION OF THE DRAWINGS

Reference is now made to the following descriptions taken in conjunction with the accompanying drawings, in which.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

Embodiments of the present disclosure provide a fireplace liner, designed in some embodiments, to obscure or completely hide the burner assembly of the fireplace, to addresses customer demands for a more aesthetically pleasing look, while at the same time meeting requisite technical requirements for air flow to the burner.

It was found that piling up loose media around and over the burner assembly makes it difficult to achieve satisfactory combustion of fuel, and can obscure the flame itself from view. Certain embodiments of the fireplace liner of the present disclosure address these problems by providing troughs that promote bilateral secondary air flow to the burner head to produce a taller flame that does not stick to the sides of the liner components. A taller flame, in turn, facilitates embodiments where the burner assembly can be recessed below the liner, and can have the added benefit of giving the appearance of there being more flame than there actually is, for a given amount of fuel flow to the burner. The width, number of troughs and the secondary air flow through the troughs of the liner can be adjusted thereby providing new variables to control the shape and size of the flame in a manner not previously recognized.

The term secondary airflow, as used herein, refers to airflow to the burner assembly that is separate from the primary airflow that is entrained with the fuel within the burner assembly itself.

Figure 1:
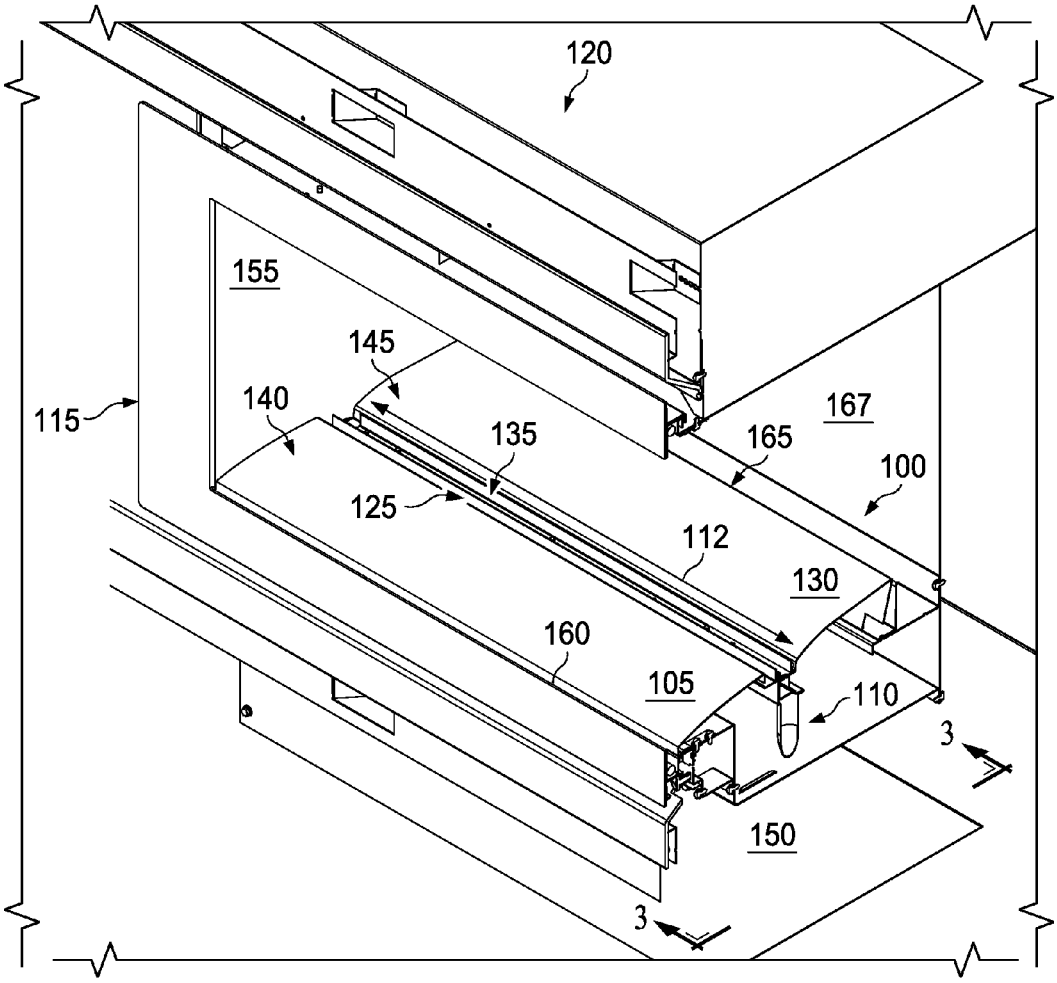
FIG. 1 presents a perspective front view of an example embodiment of a fireplace liner of the disclosure.
Figure 2:
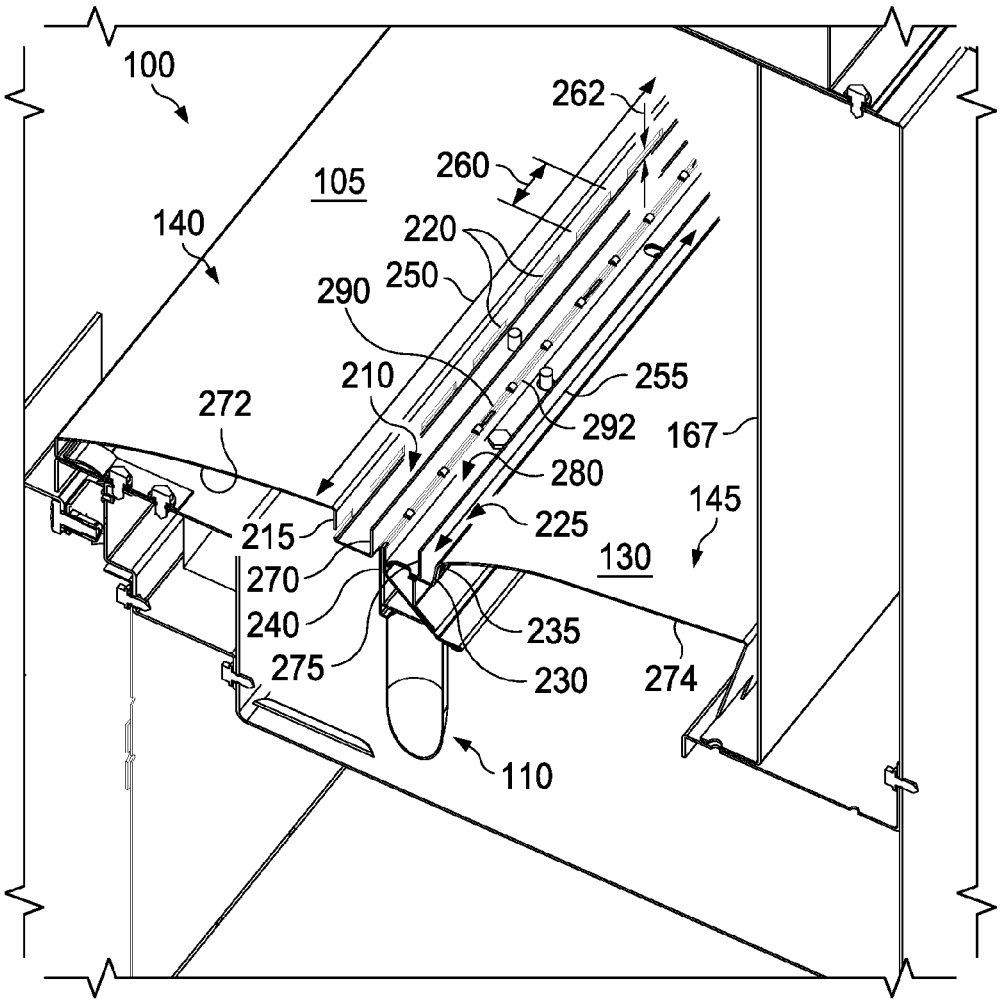
FIG. 2 presents a perspective side view of an example embodiment of a fireplace liner of the disclosure similar to the liner depicted in FIG. 1.
Figure 3:
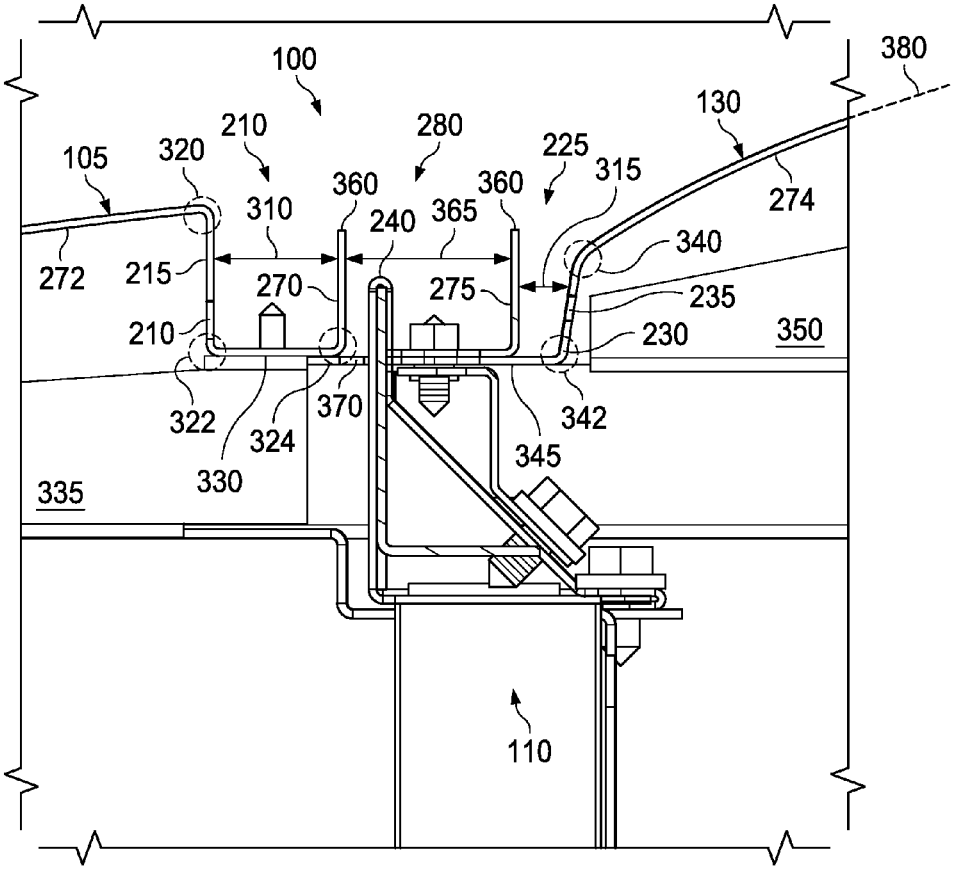
FIG. 3 presents a side view of an example fireplace liner of the disclosure, similar to the liner depicted in FIG. 1, along view line 3 in FIG. 1.

One embodiment of the present disclosure is a liner for a fireplace. FIG. 1 presents a perspective front view of an example embodiment of a fireplace liner 100 of the disclosure, and FIG. 2 presents a perspective side view of an example embodiment of a fireplace liner 100 of the disclosure similar to the liner depicted in FIG. 1. FIG. 3 presents a side view of an example fireplace liner 100 of the disclosure, similar to the liner 100 depicted in FIG. 1, along view line 3 in FIG. 1.

With continuing reference to FIGS. 1-2 throughout, the liner 100 comprises a first panel 105 configured to be located in front of a fireplace burner assembly 110, the burner assembly 110 having a lateral dimension 112 that extends across a viewing window 115 of a fireplace box 120. The first panel 105 is configured to extend laterally along the lateral dimension 112 of the burner assembly 110. A rear end 125 of the first panel 105, the end nearest to the burner assembly 110, includes a first trough 210 having a vertical wall 215 with a plurality of first slots 220 therein, the first slots 220 permitting secondary air flow there-through.

The liner 100 also comprises a second panel 130 that is configured to be located behind the fireplace burner assembly 110 in the firebox 120. The second panel 130 is configured to extend laterally along the lateral dimension 112 of the burner assembly 110. A front end 135 of the second panel 130, the end nearest to the burner assembly 110, includes a second trough 225 having another vertical wall 230 with a plurality of second slots 235 therein, the second slots 225 permitting secondary air flow there-through.

As further illustrated for the embodiment shown in FIG. 1, major outer surfaces 140, 145 of the panel 105, 130 lay substantially horizontally on a floor or horizontal surface 150 of the firebox 120. In some cases the lateral dimension 112 of the burner assembly 110, or portion thereof, e.g., a burner head 240, can extend substantial across the entire firebox 120, e.g., substantially from one wall 155 to an opposing wall (not show) of the firebox 120. As further illustrated, a front end 160 of the first panel 105 is nearest the viewing window 115 of the fireplace box 120, and a rear end 165 of the second panel 130 is nearest a back wall or vertical panel 167 of the fireplace box 120.

Bilateral secondary airflow through the plurality of first slots 220 and second slots 235 is thought to be important to promoting a vertical flame to be emitted from the burner head 240 of the assembly 110 and to preventing the flame from sticking to the first or second panels 105, 130, e.g., sticking the vertical walls 215, 230 of the panels 105, 130. For instance, in some embodiments of the liner 100, the plurality first slots 220 extend along the entire length 250 of the vertical wall 215 and the plurality of second slots 235 extend along the entire length 255 of the of the other vertical wall 230. For instance, in some embodiments, the slots 220, 235 are rectangular-shaped openings have a lateral length 260 of ½ to ¾ inches (e.g., parallel with the lateral dimension 112) and vertical length 262 of ⅛ to ¼ inches. In some such embodiments, secondary airflow through the slots 220, 235 to the burner heed 240 can extend along the lateral dimension 112 of the assembly 110, to promote a vertical flame. However, in other embodiments, the number, size and location of the slots 220, 235 can be adjusted to produce different effects on the flame along the burner head 240. For instance, in some cases, there can be more slots 220, 235 in the middle than on the ends of the vertical walls 215, 230. Such a configuration would increase the velocity of secondary airflow to the middle compared to the ends of the burner head 240 and therefore decrease the amount of flame in the middle of the burner head 240. Based on the present disclosure, one of ordinary skill would appreciate how the slots could be varied to produce different flame effects.

The width of the troughs 210, 225 is also important to providing secondary airflow through the slots 220, 235 to the burner assembly 110. For instance, as illustrated in FIG. 3, in some cases, the first trough 210 has a width 310 in a range of about ⅝ to about 1 inches and the second trough 225 has width 315 in a range of about ⅜ to about ⅝ inches. Based on the present disclosure, one of ordinary skill would appreciate how the widths 310, 315 could be varied to produce different flame effects, if desired.

As further illustrated in FIGS. 2 and 3, in some embodiments of the liner 100, to facilitate further airflow control to the burner assembly 110, the first trough 210 can include a second vertical wall 270 located between the vertical wall 215 and the burner assembly 110. For instance, in some cases the first panel includes, or is, a single metal sheet 272, the rear end 125 of the metal sheet 272 including at least three substantially right angled bends 320, 322, 324 (e.g., 90±20 degree bends) to define the vertical wall 215 and the second vertical wall 270 of the first trough 210. In some cases, a base portion 330 of the first trough 210 can be used as a point of attachment (e.g., via screws, bolts, clamps or welds) to an underlying spar structure 335 of the panel 110 that is configured to provide mechanical and shaping support to the panel 110.

Similarly, the second panel 130 can include, or have, a second single metal sheet 274, the front end 135 of the second metal sheet 274 including at least two substantially right angled bends 340, 342 to define the other vertical wall 230. In some cases, the front-most portion 345 of the second panel 130 is a horizontal ledge to facilitate attachment to an underlying rear spar structure 350 of the second panel 130 (e.g., via screws, bolts, clamps or welds). The spar structure 350 is configured to provide mechanical and shaping support to the panel 110.

In some embodiments the liner 100 can further include a separate vertical wall 275 between the burner assembly 110 and the other vertical wall 230 to define the second trough 225. However, in other embodiments, a separate vertical wall is not needed, and, the front end 125 of the second panel 130 (e.g., a metal sheet 274 of the panel 130) includes a third right-angled bend to define the vertical wall 275, which can be a second vertical wall of the second trough 225.

As further illustrated in FIGS. 2 and 3, in some embodiments of the liner 100, to facilitate further control of the flame height, a second vertical wall 270 of the first trough 210 and a vertical wall 275 (e.g., a separate vertical wall 275 in some cases) of the second trough 225, define a third trough 280 located between the first trough 210 and the second trough 230. In some such embodiments, the burner head 240 is located within the third trough 280 and below tops 360 of the vertical walls 270, 275. In some embodiments, a width 365 of the third trough 280 is in a range of about ⅞ to about 1⅛ inches.

In some embodiments, the third trough 280 has a plurality of third slots 370 permitting separate tertiary airflow there-through. That is, the third slots 370 provide additional airflow to the burner assembly 110 that is not the same airflow as the secondary airflow through first and second slots 220, 235.

In some embodiments of the liner 100, however, there is no need for a second vertical wall 270 of the first trough 210 or a separate vertical wall 275 or another wall 275 of the second trough 225. For instance, in some cases burner walls 290, 292 of the burner assembly 110 can act as vertical walls to define the first and second troughs 210, 225, respectively.

As also illustrated in FIGS. 2 and 3, in some embodiments of the liner 100, the top surface 140 of the first panel 105 includes, or is, a single continuous piece configured to curve upwards, a highest point of the top surface 140 is higher than a top-most portion of the burner assembly 110 (e.g., the burner head 240 of the assembly 110). For instance, in some embodiments, the curved top surface 140 of the first panel 105 has a radius of curvature that is in the range of about 20 to about 100 inches, and more preferably about 50 to about 60 inches. For instance, in some embodiments, an underlying spar 335 of the panel 105 provides a curved surface that the top surface 140 of the first panel 105 mounts to and thereby takes on the same curvature.

In some cases, having a curved top surface 140 can facilitates hiding the burner assembly 110 over a wider range of viewing angles (e.g., viewing angles through the firebox window 115) than would be the case if the top surface was a planar surface. Having a curved top surface 140 in some cases can additionally, or alternatively, provide more consistent or uniform reflections of light and heat from the flame than a flat panel 105 would.

In some embodiments of the liner 100, top surfaces 140, 145 of the first panel 105 and the second panel 130 both curve upwards and highest portions of the first panel and the second panel are in a same substantially lateral plane 380. As illustrated in FIG. 3, in some cases, the lateral plane 380 is above the burner assembly 110 (e.g., above the burner head 240). Configuring both top surfaces 140, 145 as curved surfaces promotes having continuous visual line from the front first panel 105 to the rear second panel 130, such that a flame from the burner assembly 110 appears to be coming out of the middle of a single panel.

In some embodiments, to provide a contrasting background for a flame emitted from the burner assembly 110, the top surfaces 140, 145 of the first panel 105 and the second panel 130 both have a dark high glossy finish. E.g., in some cases, the top surfaces 140, 145 have a black or dark brown porcelain enamel finish.

Figure 4:
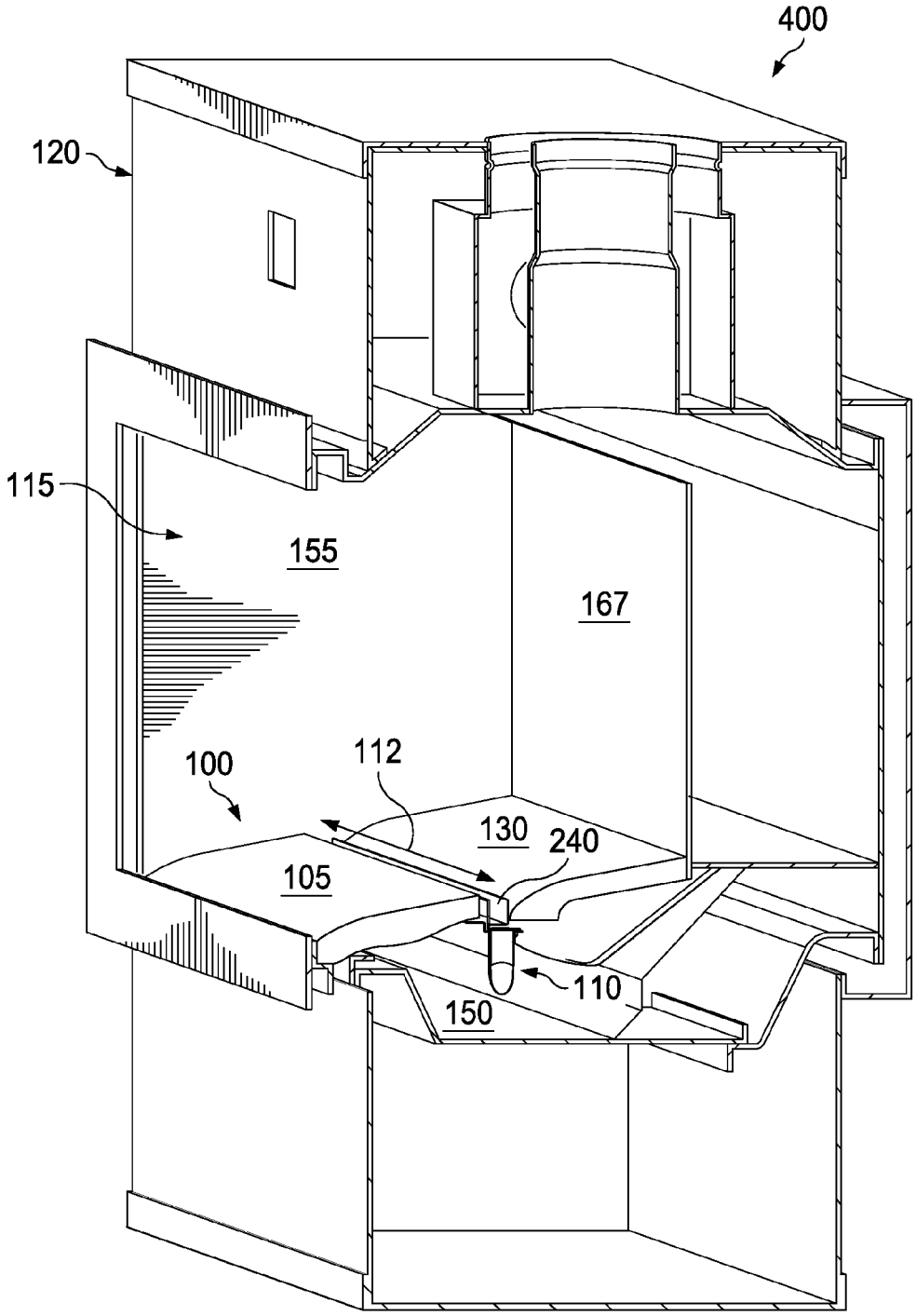
FIG. 4 presents a cut-away perspective view of an example embodiment of selected portions of a fireplace of the disclosure, the fireplace including the disclosed fireplace liner, including any of the embodiments discussed in the context of FIG. 1-3.

Another embodiment of the disclosure is a fireplace that includes the fireplace liner of the disclosure. FIG. 4 presents a cut-away perspective view of an example embodiment of selected portions of a fireplace 400 of the disclosure. The fireplace 400 comprises a fireplace box 120 having a viewing window 115, and, a burner assembly 110 having a lateral dimension 112 that extends across the viewing window 115 of the fireplace box 120. The fireplace 400 also comprises a fireplace liner 100. The liner 100 can be any of the example embodiments of the liners discussed in the context of FIGS. 1-4.

For instance, as discussed in the context of FIGS. 1-2, the liner 100 includes a first panel 105 located in front of burner assembly 110 and extending laterally along the lateral dimension 112, a rear end 125 nearest the burner assembly 110 including a first trough 210 having a vertical wall 215 with a plurality of first slots 220 therein, the first slots permitting secondary air flow there-through. The liner 100 includes a second panel 130 located behind the fireplace burner assembly 110 and extending laterally parallel along the lateral dimension 112, a front end 135 nearest the burner assembly 110 including a second trough 225 having another vertical wall 230 with a plurality of second slots 235 therein, the second slots 235 permitting secondary air flow there-through.

For instance, in some cases, as discussed in the context of FIGS. 1-3, in various embodiments the first panel 105 is or includes a single metal sheet 272 having a rear end 140 with right angled bends 320, 322, 324 to define the vertical wall 215, and in some cases, the second vertical wall 270 of the first trough 210. Similarly, in some cases, the front end 145 of the second panel 130 can include at least two substantially right angled bends 340 342 in a second metal sheet 274 to define the other vertical wall 230, and in some cases a second vertical wall 275, to define the second trough 225.

In some cases, for example, the second vertical wall 270 of the first trough 210 and a separate vertical wall 275 between the burner assembly 110 and the other vertical wall 230 of the second trough 225, define a third trough 280 located between the first and second troughs 210, 225, wherein a portion of the burner assembly 110 (e.g., a burner head 240) is located in the third trough 280. In some cases, for example, wherein the vertical wall 215 and a burner wall 290 of the burner assembly 110 define the first trough 210. In some cases, the other vertical wall 230 and a burner wall 295 of the burner assembly 110 define the second trough 225. In some cases, for instance, one or both of the surfaces 140, 145 of the panels 105, 130 can have an upward curve. In some cases, the burner assembly 110 is not visible from the viewing window 115.

Figure 5:
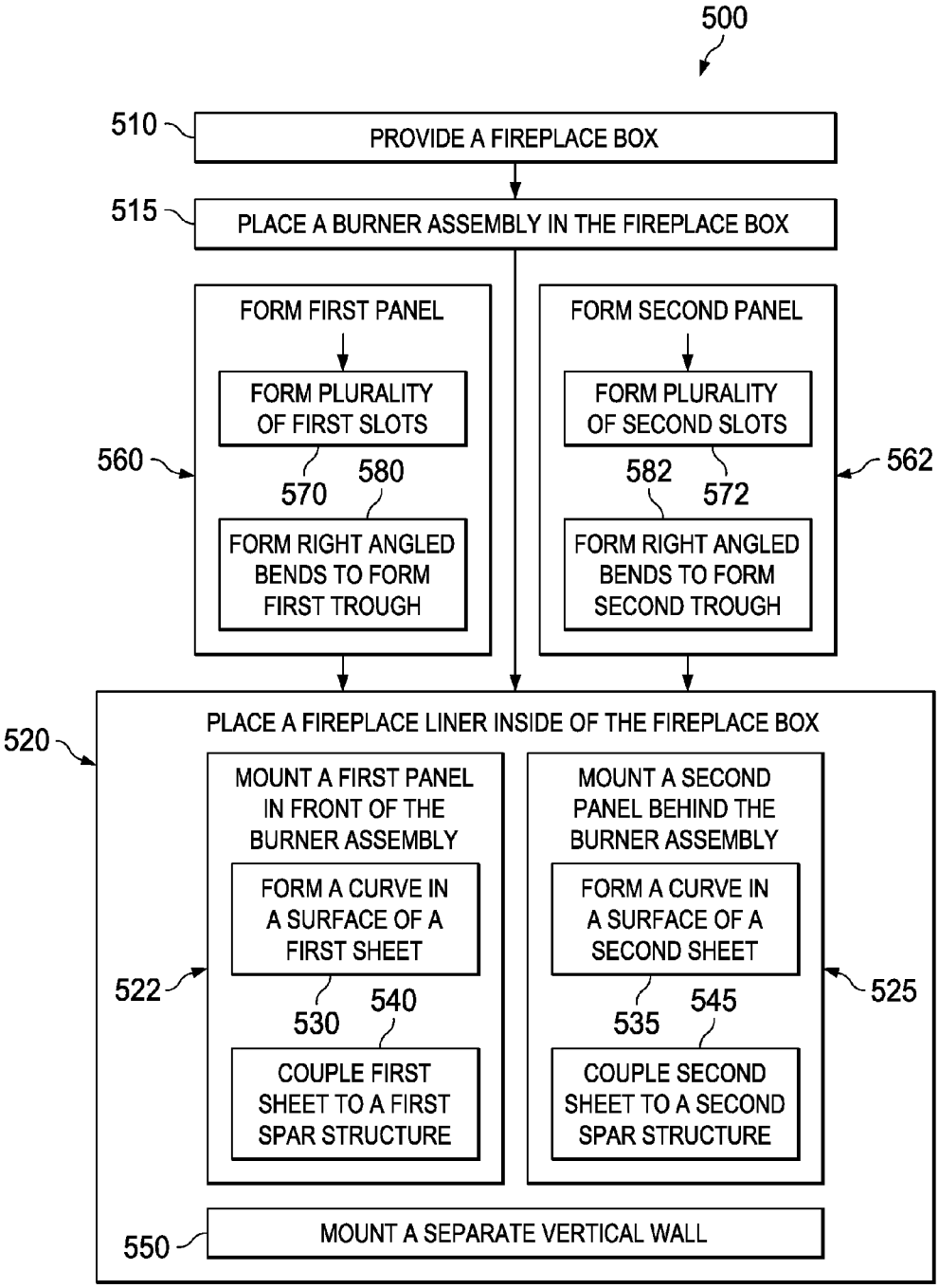
FIG. 5 presents a flow diagram of an example method of manufacturing a fireplace which includes placing a fireplace liner inside the fireplace box, including any of the example embodiments of the liners discussed in the context of FIGS. 1-4.

Another embodiment of the present disclosure is a method of manufacturing a fireplace, such as any of the fireplace 400 embodiments, and its component parts, including the liner 100, as discussed in the context of FIGS. 1-4. FIG. 5 presents a flow diagram of an example method 500 of manufacture.

With continuing reference to FIGS. 1-5 throughout, the example method 500 comprises a step 510 of providing a fireplace box 120, e.g., such as a prefabricated in-wall fireplace box. The method 500 comprises a step 515 of placing a burner assembly 110 in the fireplace box 120, such that a lateral dimension 112 of the burner assembly 110 extends across a viewing window 115 of the fireplace box 120. The method 500 also comprises a step 520 placing a fireplace liner 100 inside the fireplace box 120.

Placing the liner 100 in step 520 includes a step 522 of mounting a first panel 105 in front of the burner assembly 110, such that the panel 105 extends laterally along the lateral dimension 112, and a rear end 140 of the panel 105, nearest to the burner assembly 110, includes a first trough 210 having a vertical wall 215 with a plurality of first slots 220 therein, the first slots 220 permitting secondary air flow there-through.

Placing the liner 100 in step 520 also includes a step 525 of mounting a second panel 130 behind the burner assembly 110 such that, the second panel extends laterally along lateral dimension 112, and a front end 145 of the second panel 130, nearest to the burner assembly 110, includes a second trough 225 having another vertical wall 230 with a plurality of second slots 235 therein, the second slots 235 permitting secondary air flow there-through.

In some embodiment, the step 520 of placing the fireplace liner 100 in the fireplace box 120 hides the burner assembly 110 from a viewer looking through the view window 115.

In some embodiments, to facilitate hiding the burner assembly 110 from view, the step 522 of mounting the first panel 105 includes a step 530 of forming a curve in a surface 140 of a metal sheet 272 of the panel 105, and, a step 535 of coupling the curved metal sheet 272 to a spar structure 335 (e.g., a spar structure with a curved coupling surface).

In some embodiments, the step 525 of mounting the second panel 130 includes a step 540 of forming curve in a surface 145 of a second metal sheet 274 of the panel 130, and, a step 545 of coupling the second curved metal sheet 274 to a second spar structure 350 (e.g., a spar structure with a curved coupling surface).

In some embodiments, placing the liner 100 in step 520 also includes a step 550 of mounting a separate vertical wall 275 between the burner assembly 110 and the other vertical wall 230 to define the second trough 225.

Some embodiments of the method 500 further include a step 560 of forming the first panel 105 and a step 562 of forming the second panel 130. Forming the first panel 105 in step 560 can further include a step 570 of forming the plurality of the first slots 220 (e.g., a row of slots that would run parallel to the long dimension 112 when the panel 105 is mounted in step 522) in an end 140 of the first metal sheet 272. Forming second panel 130 in step 562 includes a step 572 of forming the plurality of the second slots 230 (e.g., a row of slots that would run parallel to the long dimension 112 when the panel 130 is mounted in step 525) in an end 145 of the second metal sheet 274.

Forming the first panel 105 in step 560 can further include a step 580 of forming right-angled bends in an end 140 of the metal sheet 272 (e.g., the end 140 that includes a row of first slots 220) to form one or more vertical walls 215, 270 of the first trough 210. Forming the second panel 130 in step 560 can further include a step 582 of forming right-angled bends in an end 145 of the metal sheet 274 (e.g., the end 145 that includes a row of second slots 235) to form one or more vertical walls 230, 275 of the second trough 225.

Those skilled in the art to which this application relates will appreciate that other and further additions, deletions, substitutions and modifications may be made to the described embodiments.

The invention claimed is:

1. A fireplace liner, comprising:

a first panel locatable in front of a fireplace burner assembly that has a lateral dimension that extends across a viewing window of a fireplace box, wherein:

the first panel extends laterally along the lateral dimension, a front end of the first panel corresponds to a front side of the liner and a rear end of the first panel, nearest to the burner assembly, includes a first trough having a vertical wall with a plurality of first slots therein, the first slots permitting secondary air flow there-through, and the first panel includes a continuous top surface extending from the rear end to the front end of the panel, the continuous top surface having an upwards curve located in between the front end and the rear end such that a highest point of the upwards curve is higher than the burner assembly, and the continuous top surface provides a uniform reflection of light and heat from a flame emitted from the burner head; and a second panel locatable behind the fireplace burner assembly in the firebox, wherein:

the second panel extends laterally along the lateral dimension, and a front end of the second panel, nearest to the burner assembly, includes a second trough having another vertical wall with a plurality of second slots therein, the second slots permitting secondary air flow there-through.

2. The liner of claim 1, wherein the plurality first slots extend along the entire length of the vertical wall, and, the plurality of second slots extend along the entire length of the other vertical wall.

3. The liner of claim 1, wherein the first trough includes a second vertical wall located between the vertical wall and the burner assembly.

4. The liner of claim 3, wherein the first panel includes a single metal sheet, the rear end of the metal sheet including at least three substantially right angled bends to define the vertical wall and the second vertical wall of the first trough.

5. The liner of claim 1, wherein the second panel is a single metal sheet, the front end of the metal sheet including at least two substantially right angled bends to define the other vertical wall.

6. The liner of claim 1, further including a separate vertical wall between the burner assembly and the other vertical wall to define the second trough.

7. The liner of claim 1, wherein the front end of the second panel includes at least three substantially right angled bends to define the other vertical wall and a second vertical wall of the second trough.

8. The liner of claim 1, wherein a second vertical wall of the first trough and a separate vertical wall of the second trough, define a third trough located between the first trough and the second trough.

9. The liner of claim 8, wherein the third trough has a plurality of third slots permitting separate tertiary airflow there-through.

10. The liner of claim 1, wherein the second panel includes a continuous second top surface extending from the front end to a rear end of the second panel, the rear end of the second panel corresponding to a rear of the liner, the continuous second top surface having an upwards curve located in between the front end and the rear end such that a highest point of the upwards curve of the second top surface is higher than the burner assembly.

11. The liner of claim 10, wherein the highest point of the upwards curve of the first top surface and the highest point of the upwards curve of the second top surface are in a same highest lateral plane of the liner.

12. The liner of claim 1, wherein the first top surface of the first panel and the second top surface of the second panel both have a dark high glossy finish.

13. A fireplace, comprising:

a fireplace box having a viewing window;

a burner assembly having a lateral dimension that extends across the viewing window; and a fireplace liner, including:

a first panel located in front of the burner assembly, wherein:

the first panel extends laterally along the lateral dimension, a front end of the first panel corresponds to a front side of the liner and a rear end of the first panel, nearest to the burner assembly, includes a first trough having a vertical wall with a plurality of first slots therein, the first slots permitting secondary air flow there-through, and the first panel includes a continuous top surface extending from the rear end to the front end of the panel, the continuous top surface having an upwards curve located in between the front end and the rear end such that a highest point of the upwards curve is higher than the burner assembly, and the continuous top surface provides a uniform reflection of light and heat from a flame emitted from the burner head; and a second panel located behind the fireplace burner assembly, wherein:

the second panel extends laterally along the lateral dimension, and a front end of the second panel, nearest to the burner assembly, includes a second trough having another vertical wall with a plurality of second slots therein, the second slots permitting secondary air flow there-through.

14. The fireplace of claim 13, wherein a second vertical wall of the first trough and a separate vertical wall between the burner assembly and the other vertical wall of the second trough, define a third trough located between the first trough and the second trough, wherein a portion of the burner assembly is located in the third trough.

15. The fireplace of claim 13, wherein the burner assembly is not visible from the viewing window.

16. The fireplace of claim 13, wherein the vertical wall of the first panel and a burner wall of the burner assembly define the first trough and the burner wall and the other vertical wall of the second panel define a second trough.

17. The fireplace of claim 13, wherein the second panel includes a continuous second top surface extending from the front end to a rear end of the second panel, the rear end of the second panel corresponding to a rear of the liner, the continuous second top surface having an upwards curve located in between the front end and the rear end such that a highest point of the upwards curve of the second top surface is higher than the burner assembly.

18. The fireplace of claim 17, wherein the highest point of the upwards curve of the first top surface and the highest point of the upwards curve of the second top surface are in a same highest lateral plane of the liner.

19. A method of manufacturing a fireplace, comprising:

providing a fireplace box;

placing a burner assembly in the fireplace box, such that a lateral dimension of the burner assembly extends across a viewing window of the fireplace box; and placing a fireplace liner inside the fireplace box, including:

mounting a first panel in front of the burner assembly, such that:

the first panel extends laterally along the lateral dimension, a front end of the first panel corresponds to a front side of the liner and a rear end of the first panel, nearest to the burner assembly, includes a first trough having a vertical wall with a plurality of first slots therein, the first slots permitting secondary air flow there-through, and the first panel includes a continuous top surface extending from the rear end to the front end of the panel, the continuous top surface having an upwards curve located in between the front end and the rear end such that a highest point of the upwards curve is higher than the burner assembly, and the continuous top surface provides a uniform reflection of light and heat from a flame emitted from the burner head; and mounting a second panel behind the burner assembly, such that:

the second panel extends laterally along the lateral dimension, and a front end of the second panel, nearest to the burner assembly, includes a second trough having another vertical wall with a plurality of second slots therein, the second slots permitting secondary air flow there-through.

20. The method of claim 19, wherein the second panel includes a continuous second top surface extending from the front end to a rear end of the second panel, the rear end of the second panel corresponding to a rear of the liner, the continuous second top surface having an upwards curve located in between the front end and the rear end such that a highest point of the upwards curve of the second top surface is higher than the burner assembly.

* * * * *